US011097178B2

(12) United States Patent
Gray

(10) Patent No.: US 11,097,178 B2
(45) Date of Patent: Aug. 24, 2021

(54) TACKLE SHIELD

(71) Applicant: Richard John Gray, Galashiels (GB)

(72) Inventor: Richard John Gray, Galashiels (GB)

( * ) Notice: Subject to any disclaimer, the term of this patent is extended or adjusted under 35 U.S.C. 154(b) by 0 days.

(21) Appl. No.: 16/261,274

(22) Filed: Jan. 29, 2019

(65) Prior Publication Data

US 2019/0232141 A1 Aug. 1, 2019

(30) Foreign Application Priority Data

Jan. 30, 2018 (GB) ..... 1801541

(51) Int. Cl.
*A63B 69/34* (2006.01)

(52) U.S. Cl.
CPC ..... *A63B 69/345* (2013.01); *A63B 2209/10* (2013.01); *A63B 2220/12* (2013.01); *A63B 2220/30* (2013.01); *A63B 2220/40* (2013.01); *A63B 2220/56* (2013.01); *A63B 2220/833* (2013.01); *A63B 2225/50* (2013.01); *A63B 2243/007* (2013.01); *A63B 2243/0066* (2013.01)

(58) Field of Classification Search
CPC ..... A63B 69/345; A63B 69/002; A63B 69/34; A63B 2243/0066; A63B 2243/007
USPC ..... 473/445, 444
See application file for complete search history.

(56) References Cited

U.S. PATENT DOCUMENTS

| | | | | |
|---|---|---|---|---|
| 2,574,046 | A * | 11/1951 | Logan | A63B 69/26 473/444 |
| 2,994,534 | A * | 8/1961 | Davis | A63B 69/26 473/444 |
| 2014/0302969 | A1* | 10/2014 | Chen | A63B 69/203 482/90 |
| 2015/0258408 | A1* | 9/2015 | Arena | A63B 69/345 473/444 |
| 2017/0203178 | A1* | 7/2017 | Gray | A63B 69/345 |
| 2017/0333775 | A1* | 11/2017 | Sarkees | A63B 69/345 |

* cited by examiner

*Primary Examiner* — Eugene L Kim
*Assistant Examiner* — Rayshun K Peng
(74) *Attorney, Agent, or Firm* — Blue Filament Law PLLC

(57) ABSTRACT

A tackle shield is provided having a body defining a front contact surface and a rear holding surface. The shield includes one or two or more of the following features of: two opposing lugs laterally disposed on the body; the body having an angled or curved profile such that the front contact surface has an upper forward projection and a lower forward projection and a recess therebetween; or the body has a central portion which has at the rear surface of the central portion, a holding zone in which gripping or holding members are disposed.

8 Claims, 2 Drawing Sheets

TACKLE SHIELD

FIELD OF THE INVENTION

This invention pertains generally to the field of sports training equipment and in particular to articles and apparatus to facilitate training in the tackle and collision area of ruby and other sports. More particularly, the invention relates to device for use as a tackle bag, target shield or hit shield or for other collision and tackling training purposes.

BACKGROUND OF THE INVENTION

Aids to facilitate tackling and the collision area of sports, such as the game of rugby, exist in the form of tackle bags of cylindrical form which may stand on the ground, optionally supported by a coach, for use by someone training in the sport to tackle, in the form of collision shields fitted with straps to be held by a coach and tackled by someone training in the sport and in the form of tackle bags having a cut-out formed therein to partially receive a ball, which may be held in place with an integrated strap.

The present inventor has invented a new training device for use in rugby, American Football or other collision sport training.

Problem to be Solved by the Invention

There is a need for improvements in sports training devices which improve a tackle or collision training effect in Rugby, American Football or other collision sport.

It is an object of this invention to provide an article for facilitating sports tackle and collision training that is versatile, mobile, low-cost, efficient to manufacture and capable of targeting a specific training effect.

SUMMARY OF THE INVENTION

In accordance with a first aspect of the invention, there is provided a tackle shield having a body defining a front contact surface and a rear holding surface, and wherein the shield further comprises one or two or more of the following features:

the shield comprises two opposing lugs laterally disposed on the body;

the body has an angled or curved profile whereby the front contact surface has an upper forward projection and a lower forward projection and a recess therebetween; and the body comprises a central portion which comprises at its rear surface a holding zone in which gripping or holding members are disposed.

Advantages of the Invention

The sports training device of the invention provides a tackle shield that is mobile and effective in targeted collision training techniques.

DETAILED DESCRIPTION OF THE INVENTION

Figure 1:
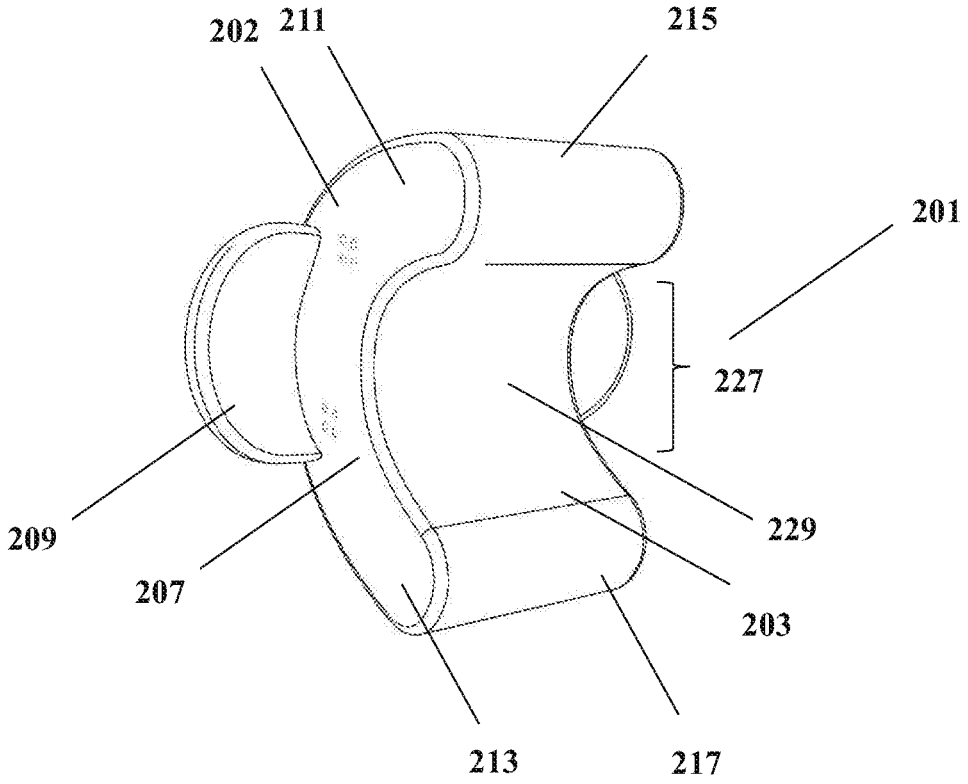
FIG. 1 is a front perspective view of an article of one embodiment of the present invention.

The invention provides a tackle shield which has a body defining a contact or collision surface, which may be referred to as a front contact or collision surface due to its orientation in use held by a coach, and an opposing holding surface or rear holding surface, which is typically the surface adjacent the a coach or person holding the article for use in training. The tackle shield may have any or a combination of: two opposing lugs laterally disposed on the body; a body having an angled or curved profile whereby the front contact surface has an upper forward projection and a lower forward projection and a recess therebetween; and the body comprises a central portion which comprises at its rear surface a holding zone in which gripping or holding members are disposed. Preferably, the tackle shield comprises a body having an angled or curved profile whereby the front contact surface has an upper forward projection and a lower forward projection and a recess therebetween. Preferably, the shield also has two opposing lugs laterally disposed on the body. And preferably, the shield further comprises a central portion which comprises at its rear surface a holding zone in which gripping or holding members are disposed.

The upper forward protrusion may alternatively be referred to as a head projection. The lower forward protrusion may alternatively be referred to as a lip projection. The upper and lower forward protrusions are preferably integral to the body and, optionally together with a central portion, define the body. The body, may alternatively be considered to comprise of a curved profile which defines an upper and lower forward projection.

Preferably, the body defines a curved profile, which is preferably substantially c-shaped.

The upper forward projection and lower forward projection are disposed at an angle to one another of up to 135 degrees (taking, for example in a curved body, a nearest fit line to the distal end of each projection through the respective third of the length of the body), preferably up to 105 degrees, more preferably up to 95 degrees, still more preferably up to 90 degrees. Preferably upper forward projection and lower forward projection are disposed at an angle to one another of at least 30 degrees, more preferably at least 45 degrees, still more preferably at least 60 degrees.

The upper forward projection and lower forward projection preferably define a volume in the recess therebetween, which may be defined as the volume within the recess as defined by the projections and a plane (e.g. if you placed the projections against a flat surface) of from 17.5 litres to 40 litres, preferably 20 litres to 35, more preferably up to 30 litres such as from 22 litres to 28 litres, more preferably 24 litres to 26 litres, such as about 25 litres. In a preferred embodiment, the volume of the recess is no more than about 27.5 litres. By having a more limited volume, according to a preferred embodiment, there is a tighter target for the user which thus forces a greater accuracy in the approach. At the same time there needs to be sufficient volume for the user torso (leading with the shoulder, typically) to extend into the volume of the recess during the training exercise.

Preferably the upper forward projection has a head distal end, being the end point of the upper forward projection disposed furthest from a holding zone of a rear surface of the body. Preferably the lower forward projection has a lip distal end being the end point of the lower forward projection disposed furthest from the holding zone of a rear surface of the body.

Preferably, the distal ends of the upper and lower forward projections are separated by 35 to 60 cm, more preferably 40 to 50 cm and still more preferably 44 to 48 cm. The distal ends may extend to up to 45 cm from the rearmost surface (the handle area), more preferably up to about 40 cm, still more preferably up to about 38 cm and preferably at least 30 cm, e.g. about 35 cm.

The tackle shield preferably comprises a central portion from which the upper and lower projections extend. The central portion comprises at its rear surface the holding zone. The lugs preferably extend from the central portion. The lugs may extend from a side surface of the body or may define both the lugs and the back surface in a single extended element. In any case, it is preferred that the lugs are disposed adjacent the rear surface and in particular the holding or gripping surface, to provide protection to a coach or other third person holding the tackle shield, such as from the helmet or arms of the user or player using the shield. The lugs also serve a particular training purpose, since the coach or third party holding the shield can clearly see when a shoulder-led tackle is effectively carried out since the player or user's head should be close to the body (e.g. to a side of the body) and will butt into the respective lug, which will be, in a preferred embodiment, moved toward the coach relative to the body, signally an effective shoulder drive. Preferably, the lugs extend laterally, in opposing directions, from the body by an amount of at least 5 cm, preferably at least 10 cm and preferably up to 30 cm, more preferably up to 25 cm, preferably in the range 12 to 22 cm, more preferably in the range 14 to 22 cm, e.g. about 15 to 17 cm or about 19 to 21 cm. Each lug may be any suitable thickness, but is typically less thick than the body, such as up to 10 cm in thickness, such as up to 8 cm thickness, preferably at least 1 cm, more preferably at least 2 cm, e.g. from 3 to 6 cm. The lugs may have a curved surface, having a concave surface toward the contact surface of the body or toward the holding surface of the body. Preferably, the lugs are generally planar. The lugs may extend orthogonally from the body (or body member as it may be referred), such as from a side surface of the body or orthogonally to a plane bisecting the holding surface, the contact surface, the upper forward projection and the lower forward projection. Optionally, the lugs may be disposed at an angle to such a plane, e.g. up to 45 degrees, toward or away from the contact surface, e.g. up to 30 degrees, or up to 15 degrees or up to 10 degrees. In one embodiment, the lugs are disposed at least 15 degrees from the mentioned plane.

The lugs may be any suitable shape, such as triangular, quadrangular, pentagonal, hexagonal, heptagonal, octagonal other angled shape. Preferably, the lugs define a curved member such as a segment of a circle or of an oval. The lugs may extend from an extent along a length of the body (i.e. the height of the lugs) of up to about 40 cm and preferably at least 10 cm, more preferably at least 15 cm, still more preferably at least 20 cm, e.g. at least 25 cm, and more preferably up to 38 cm. Optionally, the lugs can have such an extent of up to 30 cm, but preferably, the extent along the length of the body (i.e. at the junction with the body) is at least 30 cm, e.g. about 32 to 36 cm. Preferably they have such an extent to allow protection to the coach or third party holding the shield whilst enabling them to see over the lugs to help coach the user. The lugs preferably are disposed generally adjacent to the holding or gripping members that are disposed on the body.

The lugs may be rigidly disposed against the body or may be movable or flexible relative to the body, such as by way of a living hinge. The lugs may be of a firm foam or may be a soft malleable materials such as a foam.

In a preferred embodiment, the lugs comprise a foam interior but are not rigidly fixed to the body but are movable relative thereto, e.g. about a living hinge or at the junction between the lug and the body.

The body preferably has a front contact surface and rear holding surface separated, at the central portion, by side surfaces, which are preferably clearly defined and preferably parallel to one another (although they may optionally disposed at an angle so that the contact surface is wider than the holding surface or vice versa).

Preferably, the body of the tackle shield may be defined as having a central portion, which is generally the portion of the body on which the gripping members or handles, for the coach, are disposed. This may be considered to be the 30 cm of the body centered about the handles or gripping members. Optionally, a (virtual) central plane is defined as a best fitting plane to the rear (or holding) surface of the central portion of the body. This defines the normal holding plane of the shield were the coach to hold the shield upright (although they may in practice tip the shield in use to vary the training effect). The upper and lower projections may be defined in terms of the angle they are disposed relative to this central plane. Preferably, the upper forward projection extends from the central portion at an angle to the central plane of from 45 degrees to 90 degrees, preferably from about 60 degrees to about 80 degrees, e.g. from 65 to 75 degrees and preferably about 70 degrees. This angle corresponds to a best fit to the distal half of the projection (extending from the rear surface to its distal end) and extending that best fit until it intersects the central plane. The lower forward projection preferably extends from the central portion at an angle to the central plane of from 30 to 60 degrees, more preferably 35 to 55 degrees, still more preferably 40 to 50, e.g. about 45 degrees (and ideally a little more than 45 degrees).

Preferably, the upper forward projection extends from the central portion (measured from a mid-point in the central portion and the central plane in particular) by an amount of at least 30 cm, preferably at least 35 cm, more preferably no more than 50 cm, more preferably no more than 45 cm, preferably at least 40 cm and more preferably from 41 to 43 cm.

Preferably, the lower forward projection extends from the central portion (measured from a mid-point in the central portion and the central plane in particular) by an amount of at least 30 cm, preferably at least 35 cm, more preferably no more than 50 cm, more preferably no more than 45 cm, preferably at least 40 cm and more preferably from 41 to 43 cm. More preferably, the lower forward projection extends from the central plane by an amount of no more than about 45 cm.

Preferably, the lower forward projection extends by an amount from the central plane no more than 30% more than the upper forward projection, preferably no more than 20% more, still more preferably no more than 10% more. Optionally, the lower forward projection extends by an amount from the central plane no more than the upper forward projection, and more preferably is at up to 10% shorter and optionally at least 10% shorter. Preferably, it is within 20% more or less.

By having the lower forward projection extend no further than the upper forward projection, the shield may be used in a flexible way that offers training variations—for example, the shield may be tipped forward to make the upper projection extend further downward so that the player training has to approach from a lower position and drive upward into the recess. Alternatively, the coach may crouch and hold the shield closer to the ground to train techniques in low approach, whilst maintaining the contact and the drive into the shield.

A further advantage of a lower forward projection having the preferred dimension discussed above is that in a player approaching in dip and then rising into the recess, the knees and feet are free to continue to drive the tackle manoeuvre forward.

The rear holding surface comprises gripping or holding members (for a coach to hold the shield). The rear holding surface preferably comprises a holding zone within which the gripping or holding members are disposed, which holding zone is in the middle third of the shield typically and may define the central portion of the body. The gripping or holding members preferably comprise on each side of the holding zone an upright strap for passing an arm through and holding to another upright strap or grip member on the opposing side of the holding zone. Preferably a second upright strap is provided so that holding by passing an arm through a strap can be done with a left arm or right arm or both. Preferably therefore, there are provided two straps and two handles at least.

Preferably, the body has a height or longitudinal extent of up to 75 cm and preferably at least 45 cm (e.g. for a junior), more preferably at least 50 cm, still more preferably at least 55 cm, still more preferably up to 70 cm, more preferably up to 65 cm and most preferably from 58 to 62 cm and e.g. about 60 cm. By having the height as no more than say 70 cm and more preferably no more than 65 cm, the shield is maneuverable and may be used in a flexible way, such as in a crouched format or while the coach is running, to create a moving target for the player training.

Preferably the body has a width of at least 24 cm, more preferably at least 28 cm, still more preferably at least 30 cm, more preferably no more than 42 cm, still more preferably up to 40 cm, more preferably in the range 32 to 38 cm, such as 34 to 37 ad preferably about 36 cm.

The thickness of the body (or depth) at the middle portion is preferably from at least 12, more preferably at least 15 cm up to about 30 cm, more preferably up to about 24 cm and still more preferably from 18 to 22 cm, e.g. about 20 cm.

The thickness of the body as it extends into the projections is preferably within the above general ranges. Preferably the body tapers toward the distal ends of the projections. Preferably, the body has a thickness within the preferred range of 18 to 22 cm, up until the last 25% of the length of the projections when it tapers toward the distal ends.

By providing a body of the above preferred width and thickness, the shield is effective in tackle training in that a player training may exercise the full gamut of movements associated with a tackle in which a low approach is achieved and a rise into the recess to shoulder against the contact surface within the recess and at the same time wrap the arms around the body to grip the body at the junction of side and rear surface. The size of the body enables a wrap around technique during the tackle exercise which will mimic a tackle in the sport, e.g. of American Football and improve technique.

The shield of the present invention finds particular application in training players in rugby and in particular American Football in tackling and blocking technique. In one use, the coach may hold the shield in a static position with the central plane generally upright (to have the recess relatively open) and in a standing position. Here the player training will approach in a dipped stature to be able to drive up into the recess and under the slightly downturned upper forward projection and optionally drive forward in the tackle. The coach may then vary the holding position, by tipping the shield forward thereby lowing the distal end and closing the approach to the recess somewhat, which forces the player to approach from a lower position and to drive up harder into the recess, thereby improving strength and technique and optionally doing so gradually. Further, the coach may hold the shield from a crouched position, lowering the overall position of the tackle being trained for. In each of these exercises, the shield may be held square to the approaching player, which is the more straightforward approach, or may be angled to the player to mimic approaching a tackle from the side and allows the player and coach to train in tackle technique in which the approaching player has to position themselves as the approach low to adopt a position square to the shield to maximize the effectiveness of the tackle and then to drive through with the shoulder ideally in a central zone of the contact surface within the recess. In another use, the coach may hold the shield while moving, e.g. walking or running, to provide a moving target for the player training who will typically approach from an angle rather than square on, but which trains in technique both of approaching low and driving into the tackle (to plant their shoulder into the contact surface within the recess) but also with getting square with the shield for making the contact and wrapping their arms about the body of the shield and securing a good grip. These techniques will enable effective tackling in the game of American Football.

The shield enables isolation of the training effect and moving pattern for a dip and rise form of tackle. By using the shield, technique can be adapted achieve and maintain accurate track, body height, tackle entry, accurate contact and wrap, reaction speed & balance. The tackle shield facilitates training in the skill of the defender dropping his/her body height as they approach the tackle. They are then able to rise through the initial contact point to arm-wrap and finish. With this training aid the technique can be practised in a controlled safe environment (avoiding painful contact in training and potential injury) before going "live".

As mentioned above, the coach (which is inter-changeable herein with shield carrier or third person) can change the angle of the preferably "C" shaped contact shield to allow different angles of tackler entry. The tackle shield encourages excellent timing, accuracy and body movement coming into, through and finishing off the tackle.

The coach, as well as training the tackle from a square or straight approach may encourage an approach from an angle and optionally incorporate an associated move in the training approach, such as moving into the tackle immediately after dealing with a block.

The body of the tackle shield as described herein may be formed of any suitable material that is suitable for receiving contact or collisions. Typically, the elongate body comprises an outer pad that may be, for example, a shaped cover (e.g. of leather or synthetic leather, such as PVC, or textile or fabric, as is known in the art) filled with an appropriate filler (e.g. fibrous filler, fabrics, wool, reconstituted foam or shaped foamed plastic filler), or may be for example a shaped pad of resilient or resiliently compressible foam material (e.g. polyurethane) coated with a synthetic coating material or a cover (of, e.g. leather or synthetic leather, such as PVC, or textile or fabric, as is known in the art). Preferably the coating material is a laminate such as a woven or textile fabric with a PVC coating. Preferably the lugs are formed of a similar material to the body. The handles and grips are preferably formed of webbing or of leather or synthetic leather sewn onto the body.

In a further embodiment, applicable to the invention and all the embodiments hereinbefore described, a tackle shield may be further provided with a sensor or arrangement of sensors for measuring, analysing and/or monitoring technique, performance and/or improvement over time.

According to this embodiment, there may be provided sensors at one or various locations about the contact surface of the shield, whereby point of contact may be determined, as well as possible additional data relating to duration of contact and strength of contact. Similarly, sensors may be provided on the lugs and the sides and edges (e.g. where a user may be able to grip) to record when contact with the lugs take place and where the grip takes place and optionally strength and duration of grip. Optionally, the apparatus is provided with a sensor or device (e.g. in or in association with the recess) for determining one or more of distance, speed and direction of movement of the shield (e.g. accelerometer, gyrometer and/or GPS sensor). Typically, the data generated by the sensor(s) will be transmitted by wireless communication via a receiver to e.g. a microprocessor. The data may then be analysed (e.g. by a software application) to determine factors of performance about the particular user, such as accuracy of hit and power within the initial hit, whether the power was maintained or fell away after initial impact, the strength that was demonstrated and the distance, speed and direction in which the shield was moved. Thus the strengths and weaknesses of a particular player's technique can be measured and, for example, a profile created. Thus exercises to improve on weaknesses can be identified, such as through identifying changes that would improve the particular player's technique as well as strength and conditioning programmes to improve the player's performance.

Optionally, the data generated may be configured for graphical representation on a video or animated representation of a user carrying out a tackle in training on the shield to illustrate how changes in body shape, approach and technique may improve the tackle. Optionally, the data can be used to simulate tackles in game play to provide predictive outcomes in gameplay from improvements in aspects of the tackle.

Optionally, there may be further sensors (or electronics) to determine the movement achieved.

Analysis can be used to determine improvements in training methods (e.g. to learn about the most efficient techniques and adapt training methods to accommodate them) as well as to adapt coaching on technique to meet a particular player's strengths and weaknesses thus maximizing each individual's potential. Further, methods may be developed for a particular team profile (collection of individual profiles) which may inform the most effective order and timing for joining a collision event or tackle.

Sensors, typically pressure sensors, capable of determining applied pressure as well as, preferably, extent and duration of applied pressure should preferably be placed beneath the surface of the contact surface. Optionally, a multi-cell sensor element may be provided that covers a substantial portion and preferably the entire contact surface (and optionally the lugs) may be used and pressure data transmitted to a receiving device (e.g. a microprocessor) typically by wireless communication, where the data is analysed and presented back as output for immediate consumption by the user and/or the coach, e.g. in the form of number, graphs, charts or other visuals to illustrate the performance.

There is thus provided as a further aspect of the invention a training apparatus as described above, characterized in that one or more contact surface is configured with one or a plurality of sensors for determining the location, degree and extent of the contact with the contact surface. The location is preferably identified as one or a plurality of portions of the contact surface. By the degree of contact it is meant the strength of contact and by extent of contact it is meant duration (or plot of degree of contact over time).

In a further aspect, there is provided a program for a computer configured to receive data from such sensors and according to a pre-determined format, provide an output (e.g. as a digital display).

Such data may be further utilized to monitor the improvement of a player over time and also the performance of a coach over time.

In a still further aspect of the invention, there is provided a method of training a person in improved tackle technique, the method comprising: providing a tackle shield as hereinbefore defined, which surface(s) are configured with one or a plurality of sensors appropriately calibrated for determining the location, degree and extent of the contact with the contact surface(s); providing a microprocessor in signal communication (e.g. by wireless communication) with the plurality of sensors and programmed to interpret and/or analyse the sensor data; conducting one or a series of contact events in which the person follows a training instruction to contact with a training apparatus; analyzing the data associated with the one or series of contact events generated by the sensors and communicated to the microprocessor; determining weaknesses in the player technique or conditioning level by comparison of sets of the data with pre-determined (or calibrated) sets of target data associated with one or more player techniques or conditioning levels; and producing a technique or conditioning training schedule comprising training elements selected from a pre-determined set of training elements designed to improve certain weaknesses in technique or conditioning level. The person may then undertake training according to the training schedule and then may repeat the method above. Thus a new set of collision event data may be generated which may be compared with existing data sets, such as pre-determined target data (to determine perceived weaknesses), the person's previous data (to determine improvement, over time and of the perceived weaknesses as a result of the targeted training) and team data.

The effectiveness of training method (or technique or conditioning schedules) and/or the effectiveness of the conditioning coach may be assessed by performance measurement. Further, the use of person data in the context of team data may be utilized to plan game play utilizing certain player strengths (e.g. the data may indicate that certain persons in a team are better at certain parts of the tackle event, whilst other persons are better at other parts of the tackle event), which is thus a further method of the invention.

In one preferred embodiment (and in a further aspect), the tackle shield of the present invention may be used as part of a training system described below. A training system according to a further aspect of the invention is for developing tackle technique, and preferably multiple techniques (e.g. tackle follow-up technique), especially American football, the system comprising:

a padded tackling training apparatus for targeting training of tackle technique and optionally tackle follow-up technique at a level corresponding a relatively high body height, which is preferably from the hips to chest; and a tackle shield as defined above.

Preferably, the training system is for developing tackle technique, and preferably multiple techniques (e.g. tackle follow-up technique), at a range of heights, especially American football, the system comprising:

a first padded tackling training apparatus for targeted training of tackle technique and optionally tackle follow-up technique at a first level corresponding to a relatively low body height;

a second padded tackling training apparatus for targeted training of tackle technique and optionally tackle follow-up technique at a second level corresponding to a medial body height;

a third padded tackling training apparatus for targeting training of tackle technique and optionally tackle follow-up technique at a third level corresponding a relatively high body height; and a tackle shield as defined above.

In a further aspect of the invention, there is provided a training method for developing tackle technique of a player in contact sports, especially American football, the method comprising:

targeting training of tackle technique and optionally tackle follow-up technique at a level corresponding a relatively high body height (e.g. from hips to chest) and targeting training at dip and rise technique, whereby the player is provided with improved skills and techniques in tackling at during gameplay of the sport.

Preferably, the training method is for developing tackle technique of a player at a range of heights in contact sports, especially American football, the method comprising:

targeting training of tackle technique and optionally tackle follow-up technique at a first level corresponding to a relatively low body height;

targeting training of tackle technique and optionally tackle follow-up technique at a second level corresponding to a medial body height;

targeting training of tackle technique and optionally tackle follow-up technique at a third level corresponding a relatively high body height; and and targeting training at dip and rise technique.

Preferably, the system above and the tackle shield may be used with one or more further training apparatus, which may be for example one or more of the following:

In one example, a tackling training apparatus comprising a padded elongate body having a first end and a second end and a side surface defiling the surface of the body between the first and second ends and being capable of standing, self-supporting, on its first and/or second end, the elongate body having on or part of the side surface at least one gripping feature, wherein the apparatus further comprises one or more of:

a movable guiding flange member disposed about the surface of the body which is capable of being moved to multiple longitudinal positions along the length of the elongate body;

an elongate enclosed cavity within the elongate body, which cavity contains or may contain a mobile material occupying a portion of the cavity; and an interchangeable core, core assembly or internal layer of the elongate body whereby the elongate body is configured such that one or more core members or internal layers may be removed from the elongate body and substituted with alternative core members or internal layers having alternative features.

In another example, a modular tackling training apparatus comprising a padded elongate body having a first end and a second end and a side surface defining the surface of the body between the first and second ends and being capable of standing, self-supporting, on its first and/or second end, the elongate body being composed of or providing one of a plurality of modular components for:

enabling interchangeable elongate core assembly or core members within the padded elongate body to facilitate a range of weights or dynamic or other properties; and/or enabling longitudinal assembly or disassembly of the apparatus to provide for multiple different lengths of elongate body and optionally intermediate (e.g. surface) features.

In another example, a sports training apparatus having an elongate body having an outer surface having a generally prismatic form or a generally cylindrical form, the elongate body defining a longitudinal axis, the apparatus having a base at one end of the elongate body upon which the device may be stood and having one or a combination of two or more of the following features:

Disposed about the outer surface of the elongate body at least two elongate gripping members which are preferably each disposed at an angle to the longitudinal axis of between 15° and 75°.

The generally prismatic form or generally cylindrical form is a truncated prism or truncated cylinder whereby the upper end of the body opposing the base is disposed at an angle to normal to the longitudinal axis; and A ball-receiving recess is formed in a face of the elongate body into which may be disposed and removably retained a ball for use in training.

The tackle shield of the present invention finds particular application in use in combination with a padded tackling training apparatus for targeting training of tackle technique and optionally tackle follow-up technique at a level corresponding a relatively high body height, which is preferably from the hips to chest. Preferably, the tackle training apparatus comprises a cylinder having disposed on the exterior thereof elongate gripping members, which apparatus will be defined in more detail below. The high level padded tackling training apparatus and the tackle shield hereinbefore described are both concerned with targeted training at a tackle from hip to chest. The high level padded tackling training apparatus enables a tackle on a static member in a direct tackle, to improve approach and grip and in particular the momentum of the challenge to topple and hold the apparatus. The tackle shield targets the approach in a low approach format and drive upwards into the tackle whilst improving grip too by wrapping the arms around the body. The tackle shield, due to its mobility may also provide a moving target and having a defined front contact surface can allow training on an angled approach. The training techniques in dropping the hips and driving up and through in the tackle is pursued (e.g. for assisting in tackles of running backs by defenders). The angle of the drive up can be defined by the angle the coach holds the bag and so can target a drive up of up to 60 degrees, e.g. up to 45 degrees.

The tackle shield of the present invention and forming the training system and method defined above may be used in such a system and method as further defined below and the alternative and additional apparatus described in more detail below. Thus, the system, method and apparatus below may be defined herein as in combination with a tackle shield as described above and intended to augment, support or complement the training effects achieved by use of the tackle shield.

The training system of this further aspect provides for developing tackle technique and preferably enables training or coaching in multiple tackle-related techniques and preferably includes follow-up technique. The system comprises a first padded tackling training apparatus for targeted training of tackle technique and preferably tackle follow-up technique at a first level corresponding to a relatively low body height, a second padded tackling training apparatus for targeted training of tackle technique and preferably tackle follow-up technique at a second level corresponding to a medial body height, and a third padded tackling training apparatus for targeting training of tackle technique and preferably tackle follow-up technique at a third level corresponding a relatively high body height.

The method of further aspect is provided for developing tackle technique of a player at a range of heights in contact sports, especially American football, and comprises targeting training of tackle technique and preferably tackle follow-up technique at a first level corresponding to a relatively low body height, targeting training of tackle technique and preferably tackle follow-up technique at a second level corresponding to a medial body height, and targeting training of tackle technique and preferably tackle follow-up technique at a third level corresponding a relatively high body height. Thereby, the player is provided with improved skills and techniques in tackling at multiple heights during gameplay of the sport.

The method further provides providing the system and/or components of the system (or preferred embodiments of the system) for use in the method and may further comprise method steps described hereinafter in terms of method or in terms of the use of training apparatus or system components.

Preferably the first level corresponds to targeting tackles at ankle to knee height of a player to be tackled. Preferably the second level corresponds to targeting tackles at knee to hip height of a player to be tackled. Preferably the third level corresponds to targeting tackles at hip to chest height of a player to be tackled.

Preferably, the padded tackling training apparatus comprises a padded elongate body having a first end and a second end and a side surface defining the surface of the body between the first and second ends and being capable of standing, self-supporting, in its first and/or second end, the elongate body preferably having on or part of the side surface at least one gripping feature.

Optionally, there is provided as part of the system a fourth padded tackling training apparatus that is relatively heavy compared with the first, second or third tackling training apparatus. The system may comprise (and the method may use) this or further training apparatus, or the training apparatus of the system may comprises further features of further training apparatus, as described hereinafter as embodiments.

The system and method may be capable of improving the following features of tackle training.

Training with a tackling training apparatus at the appropriate level (first level, second level or third level) isolates accurate body height and the immediate tackle follow up technique of body shape, strong shape and balance for that level of tackling, with work on specific grip and arm movements within the action. This enables training of accurate body height, grip work, speed and balance. Training features achievable with this apparatus include approach bag from different angles and speeds, with varying approaches, e.g. hit ground and up, hit ground and roll then back to feet make initial hit, ensure strong arm clamp and use initial shoulder contact.

Vary training commands relating to the player gripping the elongate protrusions with single hand movement or double grab movement. The width of the bag and the spine placement has been purposely designed to make the practice difficult, more difficult than in live gameplay Optionally, a second and third player can be brought in to put pressure on tackler, as tackler gets to feet and fights for grip on apparatus, second player can attack the tackler affecting player balance.

Details and embodiments of the features mentioned and further features are hereafter described in relation to each of the aspects of the invention whether as separate aspects or in combination.

A tackling training apparatus and useable as one or more of the first, second and third apparatus of the system of the first aspect, comprises a padded elongate body having a first end and a second end and a side surface defining the surface of the body between the first and second ends and being capable of standing, self-supporting, on its first and/or second end, the elongate body having on or part of the side surface at least one gripping feature, wherein the apparatus preferably, further comprises one or more of:

a movable guiding flange member disposed about the surface of the body which is capable of being moved to multiple longitudinal positions along the length of the elongate body;

an elongate enclosed cavity within the elongate body, which cavity contains or may contain a mobile material occupying a portion of the cavity; and an interchangeable core or internal layer of the elongate body whereby the elongate body is configured such that one or more core members or internal layers may be removed from the elongate body and substituted with alternative core members or internal layers having alternative features.

Preferably, there is provided a plurality of gripping features, which may be disposed on the surface or within the surface. Preferably, the gripping features are gripping protrusions. These may be formed as part of the side surface or may be fixed onto (permanently or removably).

The gripping protrusion(s) should be sized so as to be grippable, but preferably shaped so as not to aid gripping. The gripping protrusions may be removable (e.g. attached by zip element or hook and loop arrangement), but preferably is fixedly formed onto or as part of the side surface. Preferably a plurality of gripping protrusions are provided, such as 2, 3 or 4 such protrusions and optionally 5 or more. Optionally, any arrangement of protrusions may be provided such as a plurality of semi-spherical protrusions (or cuboid equivalents) or an elongate helically arranged protrusion or protrusions. Preferably the protrusions are elongate members (or fins) running along the side surface in a direction from one end to the other and preferably extending from one end to the other (or a significant proportion of the length, such as at least 80% more preferably at least 90% and still more preferably at least 95%). Preferably, the elongate gripping members or fins are 3-15 cm wide, more preferably 5-10 cm, still more preferably 6-8 cm and most preferably about 7 cm wide. Preferably the radial depth of the elongate gripping members or fins is from 3-15 cm, more preferably 5-10 cm, still more preferably 6-8 cm and most preferably about 7 cm and may be the same or different to the width, but is preferably the same or about the same.

The protrusions (or fins) are preferably extending in a direction (longitudinal axis) substantially parallel with the longitudinal axis of the elongate body. The protrusions, which are preferably padded members sewn or otherwise affixed onto the elongate body member, are of any suitable shape (e.g. rectangular or triangular) but are preferably of circular, semi-circular or other curved cross-section.

An elongate body of the apparatus (of this preferred embodiment, or generally for use in the system) may be any suitable shape and may be irregular in shape but is preferably a prism and more preferably a cylinder.

The training apparatus (of the embodiment or of any apparatus for use in the system) may be sized to any suitable dimension (e.g. depending upon the height of targeted tackle training, as discussed above and also depending on whether coaching is for juniors or seniors—this has a particular impact on the weight of the apparatus used).

Preferably the width (diameter in the case of a cylinder) of the body member is from 20 to 60 cm, and preferably 25 to 40 cm for a junior or 35 to 50 cm, e.g. 45 cm, for a senior player.

Preferably, the length (end to end) is in the range 50 cm to 1.5 m, more preferably 60 to 125 cm. The length may, for example, be selected according to the targeted training height. Thus, an apparatus for targeted tackle training at a first level (which may be described as a first level or a junior first level) is preferably 50-100 cm in length (longitudinal extent, end to end). For a junior (e.g. under 18 or under 16, or under 180 cm), it is preferably 55 to 70 cm in length, e.g. about 60 cm. For a senior (e.g. 18 or over or over 180 cm height), it is preferably 60-90 cm in length, still more preferably 70-80 cm and most preferably about 75 cm. An apparatus for targeted tackle training at a second level is preferably 70-125 cm in length. For a junior, it is preferably 75 to 85 cm in length, e.g. about 80 cm. For a senior, it is preferably 90-115 cm in length, still more preferably 100-110 cm and most preferably about 107.5 cm. An apparatus for targeted tackle training at a third level is preferably 100-180 cm in length. For a junior, it is preferably 100 to 120 cm in length, e.g. about 110 cm. For a senior, it is preferably 120-160 cm in length, still more preferably 130-150 cm and most preferably about 140 cm.

For tackling training at different heights such as using the training apparatus for targeting differing heights described above, it is preferably that the apparatus has a weight that represents a typical in-play tackle situation. For a first level training apparatus, the weight may be for example, 10-30 kg, preferably 10-25 kg. Preferably, for a junior or for lighter weight training, the first level apparatus is 10-15 kg (e.g. about 13 kg) and for a senior, or for use as a junior heavy bag (as an alternative embodiment), the weight is 18-22 kg (e.g. about 20 kg). A third level apparatus may have a weight of, for example, 15-40 kg, e.g. 18-30 kg.

An apparatus may comprise a movable guiding flange member disposed about the surface of the body which is capable of being moved to multiple longitudinal positions along the length of the elongate body. The guiding flange may be of any suitable size to fit about the circumference of the elongate body at various points along its length so as to define a target tackling zone (e.g. a low target tackling area, a medial target tackling area or a high target tackling area). When fitted to the elongate body, the guiding flange should preferably rest in selected position without support, so that it can be positioned and then used at that position in training.

Preferably, the guiding flange, in use, should project outwards from the side surface of the elongate body to an extent to define a tackle area such that in use it is apparent if the target area has not been properly targeted. Preferably, it projects outward from the or each side surface of the elongate body by from 5 to 30 cm, more preferably at least 8 cm, e.g. from 10 to 25 cm. In one embodiment, it may project outward by at least 15 cm, and most preferably about 20 cm. In another more preferred embodiment, it projects outwards by up to 15 cm, say 11 to 13 cm and preferably about 12 cm.

The guiding flange may have any suitable length (i.e. extent along a longitudinal direction defined by the elongate body of the apparatus), but is preferably at least 3 cm, more preferably at least 5 cm and up to 20 cm, more preferably 5 to 15 cm, more preferably 7 to 11 cm e.g. about 8 cm or about 10 cm.

The guiding flange may remain in a position on the elongate body by, for example, being a snug fit to the elongate body or by way of fixings such as snap fit fixings or hook and loop fixing (e.g. Velcro).

The guiding flange may be a multi-part device forming a complete ring or parts of a ring still securable to define regions on the elongate body. For example, the guiding flange may be composed of a two-halved device, optionally linked by a hinge (e.g. a soft or living hinge) which may be secured about the elongate body and secured together or to the body. Alternatively, the flange may be a flexible elongate member that may be wrapped about the circumference of the elongate body and secured in position.

Preferably, the moveable guiding flange may be torus-shaped or a truncated tubular member. Preferably the guiding flange is unitary article.

Preferably, the moveable guiding flange may be configured to conform with the profile of the elongate body member or it may be configured to resiliently deform in cooperation with the body member when moved to one position or another. In one embodiment, where the elongate body member is cylindrical with projecting longitudinal fins or elongate projections as elongate gripping member that run along the length of the body member the flange member may define a tubular inner surface of circular profile. In the embodiment, in use, the flange may be sized to have an inner tubular diameter at a little more than the cylindrical body diameter but less than the maximum width from gripping member to gripping member whereby on pushing the flange member onto the elongate body member, over the griping members, both the gripping members and the flange member may be resiliently deformed such that the resilient force holds the flange in place but whereby it may be moved by the user pushing it down the cylinder to another location. Typically, in another embodiment, where the elongate body member is cylindrical with projecting longitudinal fins or elongate projections, the guiding flange has a profile that corresponds with the profile of the elongate body member by having notches formed therein extending from the internal surface of the guiding flange radially outward and extending the full length of the elongate guiding flange. For example, the flange may have four elongate notches disposed about its interior surface for conforming with a corresponding elongate body with four elongate protrusions disposed about its circumference. For gripping members of circular profile having a corresponding diameter, the notches may be sized to receive them, e.g. by having a width of about 50 to 100 mm, more preferably 60 to 80 mm and preferably 70 mm. Thus, the flange may be securely fitted onto the elongate body and moved along the length (along the tracks of the elongate protruding members). Thereby, a guiding flange may be used to define tackling areas.

The guiding flange finds particular utility when combined with a third level apparatus as defined above (that is a longer elongate body) whereby a first, second and third padded tackling training apparatus may be provided by a single elongate training apparatus comprising an elongate body having disposed on a side surface thereof a plurality of elongate protrusions and a corresponding movable guiding flange by moving the flange to define a first level targeted tackle area, a second level targeted tackle area or a third level targeted tackle area at any one time.

A tackling training apparatus according to another aspect, and useable as one or more of the first, second and third apparatus of the system of the first aspect and providing preferred embodiment of the apparatus of the third aspect of the invention above, is a modular training apparatus. The modular training apparatus comprises a padded elongate body having a first end and a second end and a side surface defining the surface of the body between the first and second ends and being capable of standing, self-supporting, on its first and/or second end, the elongate body being composed of or providing one of a plurality of modular components for:

enabling interchangeable elongate core members within the padded elongate body to facilitate a range of weights or dynamic or other properties; and/or enabling longitudinal assembly or disassembly of the apparatus to provide for multiple different lengths of elongate body and optionally intermediate (e.g. surface) features.

Optionally, the modular apparatus comprises a plurality of modular components for enabling longitudinal assembly or disassembly of the apparatus to provide for multiple different lengths of elongate body and optionally intermediate (e.g. surface) features. According to this embodiment two or more modular elongate body modules configured for interconnection may be assembled to form a longer composite elongate body. The configuration for interconnection may comprise, for example inter-engaging protrusions and recesses in corresponding ends of the elongate body modules. Thus different lengths of apparatus may be formed by interconnecting two or more modules. The modules may be secured by the aforementioned inter-engaging features, but optionally also by fixings such as clips, ties or hook and loop (e.g. Velcro) pads or by a neoprene sleeve covering the joint area between the modules and optionally securable (e.g. by Velcro) to a side surface on each of the elongate body modules. Optionally, a plurality of modules may be connected and then fitted into a suitably sized jacket (thus a kit may comprise a plurality of modules and a range of suitably sized jackets to fit various configurations). Optionally, modules may be provided to provide additional features such as guide flange members, by disposing a flange module between two elongate body modules.

The elongate body of the training apparatus may be a modular apparatus in that it comprises a core assembly which may be adapted to alter the properties or behaviour of the apparatus. Preferably, the core assembly may be removable and interchangeable to facilitate a range of weights or dynamic or other properties. The inter-changeable core assembly may comprise one interchangeable core component or a plurality of interchangeable core components (e.g. a central longitudinal core and one or more inner layers).

An interchangeable core component or central core (in a core assembly) may comprise or be interchanged with a foam core member (which is typically a cylindrical member) or a denser foam core member or a weight (e.g. a steel bar) or a container (e.g. for containing a mobile material).

In an embodiment where a core assembly comprises a central core and one or more concentric or coaxial tubular or inner layers, each may be interchanged with other core or tubular members or together may interchanged with a larger component (such as a large foam core or a container defining a cavity) so as to achieve desired properties.

In an embodiment of the invention comprising an interchangeable core assembly in a cylindrical tackling training apparatus, the elongate body member comprises an elongate medial body portion having a, preferably padded, end portion disposed on each end, at least one of the end portions being removable and rejoinable so as to allow access to a core assembly. The medial body portion (which defines the larger portion of the side surface of the elongate body member) comprises (other than a coat or coating disposed on the exterior surface) a side padding portion having a radial extent of less than the radius of the body portion and defining an internal cavity (which optionally is lined with a different material, such as a plastic or fabric coating on the internal surface of the side padding portion or a rigid thin tube of plastic or metal) and disposed within the internal cavity a core assembly, which as described above may comprise a single core component or multiple core components including a central core and one or more inner layers. The core assembly may also comprise multiple longitudinally divided components, if desired.

A side padding portion will typically have a radial extent of at least 10 cm, more preferably at least 15 cm and still more preferably at least 20 cm. The core assembly may have a radius of at least 2 cm (e.g. if the core component is a metal bar for adding weight) up to say 15 cm, more preferably up to 12 cm. Preferably, the core assembly has a radius of at least 5 and for example is within the range 6 to 10 cm.

The end portions preferably comprise a length of at least 5 cm and up to 25 cm, more preferably 7 cm to 15 cm and most preferably about 10 cm (that is, from the end to the abutment with the medial elongate body portion). A central area of the interior surface of the end portions define the internal cavity.

Optionally as a further feature of (or apparatus for use in) the system and method of the further aspects of the invention, there is provided a sports training apparatus having a padded elongate body having a first end and a second end and a side surface defining the surface of the body between the first and second ends and being capable of standing, self-supporting, on its first and/or second end, which elongate body defines an elongate enclosed cavity containing a mobile material, which occupies a portion of the cavity.

The apparatus may be of any suitable size or shape, but is preferably elongate and preferably prismic and most preferably cylindrical. The elongate enclosed cavity is preferably a sealed internal container, but may be an openable container. The mobile material may be any suitable material capable of moving when the device is tipped or an equivalent change in force is applied. The mobile material may be, for example, a single solid form (e.g. a disc or multiple discs on a rod, or a large ball) or may comprise multiple parts (e.g. marbles) or may be particulate in nature (e.g. sand) or may be a liquid (e.g. water). Optionally, the mobile material is a weight formed on a rod fixedly mounted in the elongate cavity whereby the weight may move along the rod when the apparatus is tipped or other appropriate change in force is applied. Alternatively, the mobile material is sand or other suitable particular material or water (or other non-viscous liquid) which may move along the internal cavity. Preferably, the mobile material is a flowable solid, such as sand.

In use, the apparatus of this embodiment may be provided in an upright (i.e. elongate direction upwards) configuration and the user may attempt to 'tackle' the padded member from the side as if it is another player bringing it to ground in a manner whereby the apparatus is tipped so as to be grounded in a substantially horizontally extended position. During the change in force applied to the apparatus during the 'tackle' or collision, by virtue of tipping and striking the apparatus an equivalent force is applied to the mobile material within the internal cavity. As the player brings the apparatus to rest on the ground, the mobile material is typically caused to continue to move in the direction of the force, which is typically after a tackle along the length of the internal cavity and as it strikes the other end of the internal cavity, the mobile material applies a corresponding force (a supplemental force) to the padded member surrounding it causing it to move further in the direction of the original 'tackle' or collision (a supplemental movement). This makes holding the apparatus during and after the 'tackle' more difficult and somewhat mimics the struggle and effort of a tackled player during the game of American football or rugby. Thus, the apparatus may be useful in training for improved holding technique, or wrapping, and holding strength during and after tackle.

Optionally the amount or weight of mobile material may be variable or adjustable by providing access to open the internal cavity, whereby the power of the supplemental force and quantum of supplemental movement may be varied as desired.

In a preferred embodiment, the apparatus is sized to replicate the training techniques to improve the tackle, wrap and hold in sport. The apparatus may be any suitable shape as with other such apparatus described herein but is preferably generally cylindrical (optionally with or without elongate gripping members extending along the side thereof). Preferably, the apparatus has a diameter of at least 30 cm up to say 60 cm and more preferably from 40 to 50 cm, preferably about 45 cm. The height may be any suitable height, but for the desired training technique it should be up to 120 cm, preferably up to 100 cm, still more preferably up to 90 cm, more preferably at least 50 cm and most preferably from 60 to 85 cm. In a particularly preferred embodiment, the height is from 70 to 80 cm and preferably about 75 cm. If the apparatus is too tall, then in order to have the desired training effect from the mobile material the weight of the apparatus may be too unwieldy and the apparatus may become too top heavy and no longer representative of the target training technique.

Preferably, the apparatus according to this aspect and embodiment has a weight of up to 50 kg, more preferably up to 45 kg and still more preferably up to 40 kg. Preferably the apparatus has a weight of at least 20 kg, more preferably at least 25 kg. More preferably, the apparatus has a weight in the range from 30 to 40 kg, still more preferably 30 to 35 kg, e.g. 32 to 34 kg. Preferably, the mobile material contributes at least 20% of the weight of the apparatus, more preferably at least 25% of the weight. Optionally, the mobile material provides from 30 to 40% of the weight. Thereby the 'pull' effect after the apparatus is knocked over is significant and is particularly effective at facilitating a low tackle, wrap and hold training technique for the tackle, wrap and roll. In a preferred embodiment, the mobile material provides from 10 to 20 kg of weight. In one embodiment, where a cylindrical apparatus is provided with an internal cavity provided with a core for containing the mobile material (which is preferably sand, e.g. kiln sand), the core may be formed of metal, e.g. steel, and the core plus mobile material may contribute from 15 to 25 kg to the weight of the apparatus which may way a total of 30 to 35 kg.

Optionally, at least one end surface of a prismic apparatus according to one embodiment may be provided with a ball retaining strap to enable a rugby ball or similar to be fitted to the end and retrieved as part of the tackle training exercise.

In a preferred embodiment of these further aspects, there is provided a movable target tackle training system comprising a tackle training member and a moveable or towable cradle member, the tackle training member and moveable cradle member configured for removable inter-engagement with one another whereby movement of the cradle member across a training surface causes corresponding movement of the tackle training member and whereby a user collision with the tackle training member during a training exercise may cause the tackle training member to disengage from the cradle member. Preferably, the removable inter-engagement is provided by the tackle training member being configured to removably fit into a corresponding receiving recess in the movable cradle member.

Preferably, the tackle training member is a padded elongate body having a first end and a second end and a side surface defining the surface of the body between the first and second ends and being capable of standing, self-supporting or supported, on its first and/or second end.

The tackle training member may comprise one or a multiplicity of further features that are independently described elsewhere herein. Optionally, the tackle training member may define an interior cavity for containing a mobile material, such as sand, as defined above. Preferably, the tackle training member comprise at least one gripping member, the elongate body having on or part of the side surface at least one gripping feature. The gripping member may be elongate, and may be disposed in an arrangement whereby the longitudinal axis is parallel with the axis of the elongate member or may be disposed at a different angle, such as to twist about the curve of the elongate body. Preferably, the elongate body has three, four or five elongate gripping members disposed along its length.

The elongate body of the tackle training member may be any suitable shape or profile (e.g. triangular, square, rectangular, pentagonal, hexagonal, heptagonal or octagonal, or oval or circular or an irregular profile and/or a profile that varies in shape/dimension along the length of the body), but is preferably generally cylindrical (e.g. circular profile) with optional surface features (such as indents or more preferably gripping members such as elongate gripping members as described elsewhere herein).

The cradle member preferably comprises a squat prismic member (preferably wider than it is tall) having a ground engaging surface, which is preferably provided by one end of the prismic member and which is preferably generally planar and flat, but which may have any other suitable shape (e.g. undulating, rippled, ribbed) or may have ground engaging members projecting therefrom (e.g. wheels). Preferably, the ground engaging surface is generally flat and planar and formed of a fabric or plastic material.

Preferably, the movable target tackle training system is configured so that the tackle training member is configured to removably fit into a corresponding receiving recess in the movable cradle member.

The cradle member preferably comprises an upper surface, an end surface opposing the ground engaging surface that defines a receiving recess configured to receive an end of a tackle training member and preferably the receiving recess is shaped to cooperate with an end of the tackle training member so as to facilitate retention of engagement of the tackle training member on the cradle while being moved and until a suitable tackle or collision on the tackle training member is effected. Preferably the receiving recess is shaped to correspond with the shape of an end of the tackle training member. Preferably, receiving recess is sized and shaped to facilitate a snug fit of the tackle training member which will allow retention of the tackle training member in the cradle member until a suitable tackle or collision is applied to the tackle training member by a user and preferably is such that the tackle training member can thereby be released from the cradle member without causing the cradle member to topple. If the cradle member is to topple during the collision or tackle training, that makes it difficult to continue the training effect.

Preferably, a recess provided in an upper surface of the has a depth of from 80 to 300 mm, more preferably up to 200 mm, more preferably from 100 to 150 mms, still more preferably from 110 to 130 mm and most preferably 120 to 125 mm. This is particularly effective when an engaging end of the tackle training member as a diameter or width of 20 to 60 cm and more preferably 30 to 50 cm and most preferably about 45 cm. Thus the recess preferably defines a diameter or width of approximately the same as that of a corresponding engaging end of the tackle training member. Preferably, the recess, which preferably defines a cylindrical-shaped recess for receiving a corresponding cylindrical shaped tackle training member has a diameter of from 20 to 60 cm, or 35 to 50 cm, more preferably at least 40 cm, still more preferably from 42 to 48 cm e.g. 45 cm. Preferably the recess is generally medially disposed in the upper surface of the cradle member.

Preferably, the cradle member has a length (or height), that is a prismic length/height, of more than the depth of the recess and more preferably up to 200 mm more than the depth of the recess, more preferably up to 100 mm more than the depth of the recess, still more preferably up to 50 mm more than the depth of the recess, and most preferably up to 25 mm more than the depth of the recess.

The cradle member may be a triangular prism, or rectangular prism, or pentagonal prism or hexagonal prism or heptagonal prism or octagonal prism or any other prismic profile (including irregular or curved profiles) but is most preferably a circular prism or cylinder having a recess disposed in its upper surface or end. Preferably the upper surface of the prism defines a peripheral surface about the recess disposed therein which peripheral surface preferably defines a maximum width or diameter of 1.5 to 3 times the recess width or diameter, which will correspond to the width or diameter of the cradle member. Preferably the cradle member has a width or diameter of at least 60 cm, more preferably at least 75 cm and preferably up to 100 cm, preferably 80 to 90 cm. By having such a width, coupled with the mentioned recess depth and preferably also the mentioned height of the cradle member, especially the preferred dimensions, the risk of overturning the cradle member during the tackle training exercise is minimized.

Preferably the cradle member is a generally cylindrical shape. Preferably the recess, which is shaped preferably to correspond with an end of the tackle training member, defines a circular profile or cylinder-receiving shape.

The cradle member may be provided with one or more attachment on its side surface for a tow rope or similar to enable the cradle (and when engaged therewith a tackle training member) to be moved by man or machine in order to provide a moving target training technique training apparatus.

The tackle training member may be sized to any suitable dimension (e.g. depending upon the height of targeted tackle training, as discussed above and also depending on whether coaching is for juniors or seniors—this has a particular impact on the weight of the apparatus used).

Preferably the width (diameter in the case of a cylinder) of the body member is from 20 to 60 cm, and preferably 25 to 40 cm for a junior or 35 to 50 cm, more preferably at least 40 cm, still more preferably from 42 to 48 cm e.g. 45 cm, for a senior player.

The length of the tackle training member may be any suitable length according to the training requirements.

Preferably, the length (end to end) is in the range 50 cm to 1.5 m, more preferably 60 to 125 cm. The length may, for example, be selected according to the targeted training height. Thus, an apparatus for targeted tackle training at a first level (which may be described as a first level or a junior first level) is preferably 50-100 cm in length (longitudinal extent, end to end). For a junior (e.g. under 18 or under 16, or under 180 cm), it is preferably 55 to 70 cm in length, e.g. about 60 cm. For a senior (e.g. 18 or over or over 180 cm height), it is preferably 60-90 cm in length, still more preferably 70-80 cm and most preferably about 75 cm. An apparatus for targeted tackle training at a second level is preferably 70-125 cm in length. For a junior, it is preferably 75 to 85 cm in length, e.g. about 80 cm. For a senior, it is preferably 90-115 cm in length, still more preferably 100-110 cm and most preferably about 107.5 cm. An apparatus for targeted tackle training at a third level is preferably 100-180 cm in length. For a junior, it is preferably 100 to 120 cm in length, e.g. about 110 cm. For a senior, it is preferably 120-160 cm in length, still more preferably 130-150 cm and most preferably about 140 cm.

For tackling training at different heights such as using the training apparatus for targeting differing heights described above, it is preferably that the apparatus has a weight that represents a typical in-play tackle situation. For a first level training apparatus, the weight may be for example, 10-30 kg, preferably 10-25 kg. Preferably, for a junior or for lighter weight training, the first level apparatus is 10-15 kg (e.g. about 13 kg) and for a senior, or for use as a junior heavy bag (as an alternative embodiment), the weight is 18-22 kg (e.g. about 20 kg). A third level apparatus may have a weight of, for example, 15-40 kg, e.g. 18-30 kg.

Preferably the tackle training member for use in the movable target tackle training system has on the side thereof or on part of the side surface at least one gripping feature and preferably a plurality of elongate gripping members.

Preferably, there is provided a plurality of gripping features, which may be disposed on the surface or within the surface. Preferably, the gripping features are gripping protrusions formed as part of the side surface or may be fixed onto (permanently or removably) the side surface. Any arrangement of protrusions may be provided such as a plurality of semi-spherical protrusions (or cuboid equivalents) or an elongate helically arranged protrusion or protrusions. Preferably the protrusions are elongate members (or fins) running along the side surface in a direction from one end to the other and preferably extending from one end to the other (or a significant proportion of the length, such as at least 50%, more preferably at least 70% and still more preferably at least 80%. Preferably, the end of the tackle training member for engaging with a recess of the cradle member is absent such elongate gripping members for at least the extend of the portion which is configured to engage with a recess in the cradle member, which may be referred to as an engagement portion of the tackle training member. It is preferred that the engagement portion and corresponding recess are regular profiles since the provision of cooperating fins or elongate gripping members on the engagement portion and cooperating shapes in the recess for such fins or gripping members can make disengagement during the training exercise more difficult. In one preferred embodiment, the elongate gripping members extend from at least 120 mm shy of the end of the tackle training member at the engagement portion.

Preferably, the elongate gripping members or fins are 3-15 cm wide, more preferably 5-10 cm, still more preferably 6-8 cm and most preferably about 7 cm wide. Preferably the radial depth of the elongate gripping members or fins is from 3-15 cm, more preferably 5-10 cm, still more preferably 6-8 cm and most preferably about 7 cm and may be the same or different to the width, but is preferably the same or about the same. The protrusions (or fins) are preferably extending in a direction (longitudinal axis) substantially parallel with the longitudinal axis of the elongate body. The protrusions, which are preferably padded members sewn or otherwise affixed onto the elongate body member, are of any suitable shape (e.g. rectangular or triangular) but are preferably of circular, semi-circular or other curved cross-section.

Optionally a tackle training member may have, as with tackle training apparatus described elsewhere herein one or more of:

a movable guiding flange member disposed about the surface of the body which is capable of being moved to multiple longitudinal positions along the length of the elongate body;

an elongate enclosed cavity within the elongate body, which cavity contains or may contain a mobile material occupying a portion of the cavity; and an interchangeable core or internal layer of the elongate body whereby the elongate body is configured such that one or more core members or internal layers may be removed from the elongate body and substituted with alternative core members or internal layers having alternative features.

In a further feature of (or apparatus for use in) the system and method of the further aspects of the invention, particularly where a tackle training apparatus without side mounted gripping members are provided, there is provided a sports training article for removably retaining a ball on a tackle bag for facilitating tackling exercises, the article comprising an extended band for fitting around the exterior of a tackle bag, the extended band comprising: at least one stretchable section for providing tension for retaining the article on a tackle bag to which it is fitted; a ball-retaining strap, provided on the band, which defines a receiving space for receiving a ball between the strap and the band; a first movement inhibiting surface for inhibiting movement of the band along a surface of a tackle bag to which it is fitted; and a second movement inhibiting surface for removably retaining a ball within a receiving space formed by the ball retaining strap across at least a portion of the second movement inhibiting surface, whereby the article is adapted for removably fitting to a tackle back and securing in position in a plurality locations on a tackle back to facilitate a variety of training exercises. Typically in use the article may be fitted to a tackle bag, which is a further aspect and preferred embodiment.

The sports training article of this embodiment provides an adaptable yet effective accessory for fitting to a variety of tackle bags, target shields and hit shields of a range of sizes to enable a ball to be removably secured to various locations on the tackle bag to enable a range of training exercises to be performed whilst retaining the article securely and safely in position during the training exercises without slippage of the article and realistic retention and release of the ball. It provides for removably retaining a ball on a tackle bag or other training bag, such as a hit shield, for facilitating tackling exercises. The article comprises an extended band for fitting around the exterior surface circumference of a tackle bag or hit shield. The article is most effective when fitted to a tackle bag with oval or circular section in which case the band is for fitting around the circumference.

The band comprises a stretchable section. It further comprises a first movement inhibiting surface configured to inhibit movement of the band relative to the tackle bag to which it is fitted and a second movement inhibiting surface configure to inhibit movement of a rugby ball when secured on the article. It further comprises a ball retaining strap which defines, together with a portion of the band, a ball receiving space between the strap and the band. The second movement inhibiting surface is provided on the band in the area defining the ball-receiving space such that when a ball is placed in the ball receiving space it is placed in contact with the second movement inhibiting surface.

The stretchable section provides the potential for tension about the tackle bag to which it is fitted to be applied by securely fitting the article to the bag and thereby facilitate retention of the article on the tackle bag.

Thus, the article may be removably fitted to a tackle bag and may be positioned at any location on a tackle bag to facilitate a range of training exercises.

Preferably, there is a retention section which comprises the first and second movement inhibiting surfaces on either face thereof. The retention section is preferably a planar material of a single or multiple layers. The movement inhibiting surfaces may comprise a coating on the band which increases friction or may comprise surface features (ridges, protrusions). Preferably, the movement inhibiting surfaces are formed by the stickiness or friction provided by the material of the retention section. Any suitable material, such as a polymer with rubberized surface, may be used. Preferably, the retention section comprises and more preferably consists essentially of rubberized PVC.

Preferably the retention section affixed at two opposing edges thereof to two portions of the stretchable section (first and second portions) which may typically be separate portions of the retention section that may be affixed together when fitting to the tackle bag. The retention section may be affixed to the portions of the stretchable section by any suitable method, such as heat sealing or preferably by stitching together.

The stretchable section is preferably formed of a material which has some degree of stretch or elasticity (relative to the retention section, for example) so that it may facilitate tightly securing the article to a tackle bag. Preferably, the stretchable section comprises or is formed of an elastic polymer and most preferably neoprene.

Preferably the articles is provided with a fixing mechanism for increasing or reducing the tension of the band acting on a tackle bag to which it is fitted. Optionally, the fixing mechanism comprises a first end portion of the band and a second end portion of the band (preferably first and second end portions of first and second portions of the stretchable portion), which second end portion comprises a receiving aperture for receiving the first end portion and wherein there is provided a fixing means for securing the first and second end portions in one of a plurality of secure relative relationships. Preferably, the first end portion comprises fixing means comprising hook and loop portions formed thereon. Thus, the article may be fitted to a range of sizes and shapes of tackle bags, hit shields and the like.

In a preferred embodiment, the article comprises an extended band having a stretchable section and a retention section, wherein the stretchable section comprises a first portion having a first end portion and a second portion having a second end portion, which first and second portions may be secured together about a tackle bag via the first and second end portions by way of a fixing mechanism provided therewith; the retention section comprises the first and second movement inhibiting surfaces on opposing faces thereof and comprises, in relation to the second movement inhibiting surface the ball retaining strap; and the first and second portions of the stretchable section are affixed to opposing edges of the retention section.

The ball-retaining strap may be unitary, but preferably comprises a strap with a fixing and tightening mechanism. It is preferably affixed (e.g. stitched) at two ends thereof to the band and preferably to a retention section. It may be strapped about a ball and secured using a fixing mechanism typically comprising hook and loop fixing means or tensioning buckle and hook and loop fixing means cooperatively provided. Preferably the ball-retaining strap has little relative give and is preferably provided of a strong material such as a textile webbing material.

The article and band may be of any suitable size or shape. Preferably it should be configured to fit to a range of sizes and shapes of training bags.

Preferably, the article is capable of providing a fitted circumference in the range 140 to 200 cm and optionally 100 to 300 cm.

Preferably, the article is provided in a form which has an open configuration with two end portions that can be secured together about a band, wherein the length from end-portion to end portion is at least 150 cm, more preferably at least 200 cm and most preferably in the range 210 to 250 cm. In a particularly preferred embodiment it is 200 to 220 cm in length.

The ball-receiving space preferably has a circumference of 55-65 cm, preferably about 60 cm or one, two or three cm less.

The width of the band is preferably up to 50 cm at a maximum and having a maximum width of at least 10 cm, more preferably in the range 20 to 35 cm and most preferably 25 to 30 cm. Preferably, the article has a retention section which is selected to have the width mentioned above. Preferably a retention section has a length of from 20 to 40 cm, preferably about 25 to 35 cm and most preferably about 30 cm. A retention section is preferably about 30 cm by 30 cm. This gives a suitably area for contact with both the ball and the surface of the bag which enables it to provide its movement inhibition function effectively.

Preferably the thickness of the material of the article is 3 cm or less, more preferably 2 cm or less and yet more preferably 1 cm or less. Typically it will be between 0.5 and 1 cm.

An article may thereby be fitted to a range of tackle bags. Preferably, the ball may be thereby retained in the ball-receiving space with a force that roughly mimics a rugby players grip during the game of rugby. By using different shapes and sizes of bag, different exercises in tackling and acquiring a ball may be facilitated.

In a further feature of (or apparatus for use in) the system and method of the first and second aspects of the invention, there is provided a sports training apparatus having an elongate body having an outer surface having a generally prismatic form or a generally cylindrical form, the elongate body defining a longitudinal axis, the apparatus having a base at one end of the elongate body upon which the device may be stood and having one or a combination of two or more of the following features:

Disposed about the outer surface of the elongate body at least two elongate gripping members which are preferably each disposed at an angle to the longitudinal axis of between 15° and 75°.

The generally prismatic form or generally cylindrical form is a truncated prism or truncated cylinder whereby the upper end of the body opposing the base is disposed at an angle to normal to the longitudinal axis; and A ball-receiving recess is formed in a face of the elongate body into which may be disposed and removably retained a ball for use in training.

The features of the present embodiment defined hereinafter may individually or together also be applied to one or more embodiments of the third and fourth aspects of the invention as described above, optionally in addition to the features of those embodiment where it does not conflict with the teaching of the particular feature.

In one embodiment, the apparatus comprises disposed about the outer surface of the elongate body at least two elongate gripping members, each disposed at an angle to the elongate body at an angle to the longitudinal axis of between 15° and 75°.

Preferably, the two gripping members are symmetrically disposed at an angle to the longitudinal axis of between 20° and 60°, preferably between about 30° and about 45°.

Preferably, the two gripping members are symmetrically disposed about the longitudinal body, defining a plane of symmetry parallel with the longitudinal axis.

Preferably, each gripping member extends at least 20% about a perimeter of the elongate body. Preferably, each gripping member extends from 30% to 50% about a perimeter of the elongate body.

Optionally, the gripping members are removably attached to the elongate body (e.g. with a hook and loop fixing), but preferably, the gripping members are permanently affixed to the elongate body.

The gripping members may define a profile that is selected from generally quadrangular, pentagonal, hexagonal, heptagonal, octagonal, elliptical or circular. Preferably, the gripping members define a generally circular or partially circular profile.

The gripping members each have a cross sectional maximum diameter or width of 5 to 20 cm, preferably 10 to 15 cm. Preferably the gripping members are formed of a foam material with a plastic outer coating.

In a second embodiment, which may be a preferred feature of the first embodiment, the generally prismatic form or generally cylindrical form is a truncated prism or truncated cylinder whereby the upper end of the body opposing the base is disposed at an angle to normal to the longitudinal axis.

Preferably the upper end of the body defines a planar upper end face and is disposed at an angle to the normal of up to 60°, preferably from 10 to 45°, more preferably 15 to 35° and most preferably about 20° to 30°. Preferably the apparatus further comprises disposed about the outer surface of the elongate body at least two elongate gripping members, each disposed at an angle to the elongate body at an angle to the longitudinal axis of between 15° and 75°.

Preferably, the two elongate gripping members are symmetrically disposed defining a first plane of symmetry and wherein the planar upper end face disposed at an angle of up to 60° defines a second plane of symmetry and wherein the first and second planes of symmetry are co-planar.

Preferably, the first and second planes of symmetry are aligned with the longitudinal axis.

Preferably, the planar upper end face and the two elongate gripping members are disposed at an angle to one another of up to 70°, preferably from 5° to 60°, more preferably from about 30° to 55° and most preferably about 45°.

In a further, optionally preferable, embodiment (in this aspect and in other aspects of the invention), a ball-receiving recess is formed in a face of the elongate body into which may be disposed and removably retained a ball for use in training.

Preferably, at least one retaining strap is disposed on the elongate body to removably retain the ball in the receiving recess.

Preferably, the receiving recess is configured to receive a rugby ball or an American football and preferably disposed orthogonally to the longitudinal axis. Preferably, the receiving recess is disposed in the elongate body from 10 to 40% along the length of the elongate body from one of the ends, preferably from 20 to 35% and more preferably about 30% and more preferably nearer to the upper end than to the base.

Preferably, in this aspect and embodiment the apparatus further comprises disposed about the outer surface of the elongate body at least two elongate gripping members, each disposed at an angle to the elongate body at an angle to the longitudinal axis of between 15° and 75° as defined above, and preferably the two elongate gripping members flank the receiving recess, e.g. wherein the recess is disposed nearer to the upper end of the elongate member and the elongate gripping members extend from a position closer to the upper end of the elongate member than the receiving recess to a position closer to the base than receiving recess and preferably at an angle extending away from receiving recess.

Preferably the generally prismatic form or generally cylindrical form is a truncated prism or truncated cylinder whereby the upper end of the body opposing the base is disposed at an angle to normal to the longitudinal axis as defined above.

The receiving recess may define a third plane of symmetry in the elongate body.

The two elongate gripping members maybe symmetrically disposed defining a first plane of symmetry and wherein the planar upper end face disposed at an angle of up to 60° defines a second plane of symmetry and wherein the first, second and third planes of symmetry are co-planar.

The receiving recess may be disposed on the cylinder half or semi-cylinder having the longer elongate extent.

The elongate body may have a generally prismatic form having a profile shape selected from a triangle, square, rectangle, pentagon, hexagon, pentagon or octagon, preferably regular or a generally cylindrical form.

The apparatus in the present aspect or embodiment may alternatively have the following dimensions. The maximum elongate extent of the elongate body in the range 100 to 180 cm, preferably 125 to 160 cm. The maximum diameter or cross-sectional width of the elongate member from 25 to 100 cm, preferably from 30 to 75 cm and most preferably from 40 to 60 cm. The minimum diameter or cross-sectional width of the elongate member is from 25 to 100 cm, preferably from 30 to 75 cm and most preferably from 40 to 60 cm.

Optionally, the elongate body has formed therein an elongate enclosed cavity containing a mobile material, which occupies a portion of the cavity.

The elongate body usable in any of the above aspects or embodiments may be formed of any suitable material that is suitable for receiving contact or collisions. Typically, the elongate body comprises an outer pad that may be, for example, a shaped cover (e.g. of leather or synthetic leather, such as PVC, or textile or fabric, as is known in the art) filled with an appropriate filler (e.g. fibrous filler, fabrics, wool, reconstituted foam or shaped foamed plastic filler), or may be for example a shaped pad of resilient or resiliently compressible foam material (e.g. polyurethane) coated with a synthetic coating material or a cover (of, e.g. leather or synthetic leather, such as PVC, or textile or fabric, as is known in the art). Preferably the coating material is a laminate such as a woven or textile fabric with a PVC coating.

Optionally, the system of the present invention may further comprise (and the method of the present invention may further utilise) a sports training shield and in particular a rugby training shield, which is formed of a padded body portion having protruding from one face thereof a plurality of padded elongate protrusions. The training shield finds particular utility in improving the ball handling skills of a player during the tackle by practicing using the shield in holding, moving and laying off or passing a ball in a tackle or collision situation with a trainer or colleague holding the shield. The plurality of padded elongate protrusions provides a more complex arrangement of potential interruptions to body and arm movement and ball offloading actions that serve to improve ball handling, sharpness and variation in technique. In use, a trainer holds the shield in the manner of a conventional training shield with the protrusions facing away from the trainer (and toward the approaching player), whilst a player attempts to deal with a potential collision ball in hand and to offload the ball during the tackle, faced with the plurality of protrusions. Any appropriate number of protrusions may be provided but preferably at least three and ideally four or five protrusions are provided. The shield body portion may have a circular, oval, triangular, square, rectangular or other regular or irregular shaped face, but is preferably rectangular. The body portion of the shield preferably has a first face, from which the protrusions protrude, and optionally a second face of the aforementioned shape. Typically the first and second faces of the body portion are rectangular. The protrusions are preferably of cylindrical profile emanating at different directions from the body portion. The preferably cylindrical protrusions may emanate at an angle of up to 45 degrees from the normal relative to the first face of the body portion, more preferably up to 30 degrees, at least ten and still more preferably in the range 15 to 30 degrees from the normal. Most preferably any cylindrical protrusions at an angle to the normal of the body portion face extend outward (that is the protrusions preferably extend away from each other).

Preferably the protrusions are of a diameter (or maximum profile cross-sectional width) of from 10 to 30, preferably 10 to 25 and more preferably 15 to 25 cm. Preferably the protrusions extend from the body portion by up to 75 cm, preferably at least 30 cm and most preferably in the range 50 to 60 cm. The body portion should be so sized to accommodate the number of protrusions of the desired size. Preferably, the body portions which is preferably generally cuboid in shape, has a first face of dimensions in the range 50 to 100 cm, more preferably 60 to 80 cm, e.g. about 75 cm by about 30 to 60 cm, more preferably 40 to 50 cm, e.g. about 45 cm.

In a particular preferred embodiment, the body portion has a oblong first face and a central protrusion formed thereon of about have the extent of the other protrusions, and further protrusions generally emanating from proximal to each corner of the face, which further (corner) protrusions preferably emanate outward from the centre of the face by 15-30 degrees from the normal to the face.

The body portion is provided, on the back face and/or any one or more of the ends, with a means for holding or gripping the shield for the trainer, typically a strap such as an elasticated strap.

The padding and coating may be of a form and material described above for other inventions.

The invention will now be described in more detail, without limitation, with reference to the accompanying Figures.

Figure 2:
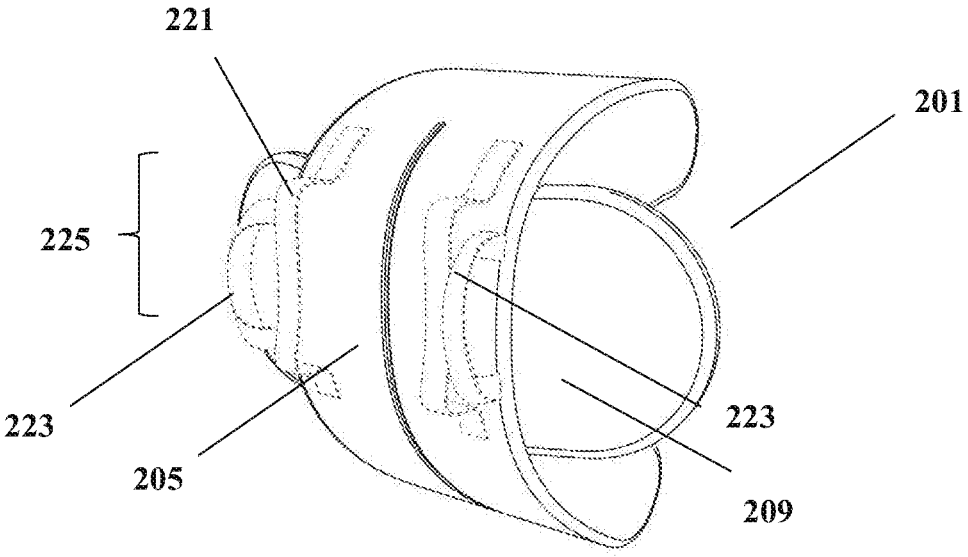
FIG. 2 is a rear perspective view of the article of FIG. 1.
Figure 3:
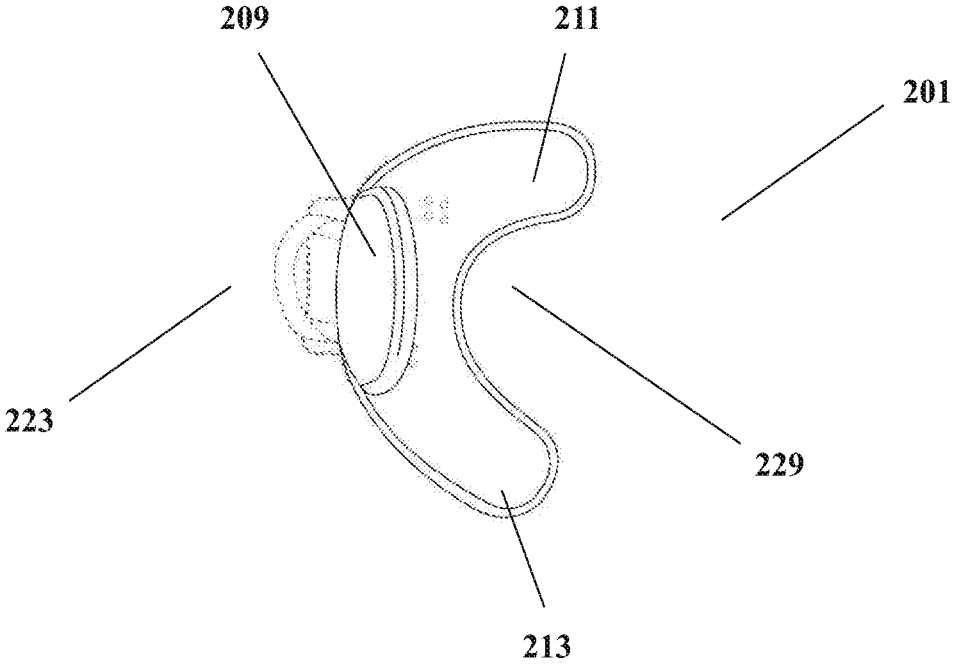
FIG. 3 is a side view of the article of FIG. 1.

In FIGS. 1 and 2, a tackle shield 201 is shown in perspective front and rear view having a C-shaped body member 202 defining a front contact surface 203 and a rear holding surface 205 separated by side surface 207. Projecting from the side surface 207 adjacent the rear surface 205 are two opposing lugs, defining a segment of an oval. The C-shaped body 202 has a central portion 227 and extending forward therefrom to define the C-shape therewith are upper forward projection 211 and lower forward projection 213 ending at respective distal ends 215,217. Defined between projections 211,213 is recess 219 into which the player training for tackles will move up into the recess 219 beneath the upper forward projection 211 and make contact with the front contact surface 203 within the recess. On the rear surface 205, a holding zone 225 is provided generally in the region of the central portion 227. The holding zone comprises a pair of gripping handles 223, one either side of the holding zone 225, and a pair of upright straps 221, one either side of the holding zone. The tackle shield can be used in the manner described above.

The invention has been described with reference to a preferred embodiment. However, it will be appreciated that variations and modifications can be effected by a person of ordinary skill in the art without departing from the scope of the invention.

The invention claimed is:

1. A tackle shield having a body defining a continuous solid body front contact surface that is absent a hole in the front contact surface and a central portion having a rear holding surface comprising gripping or holding members, and two opposing lugs laterally disposed on the body adjacent the rear holding surface of the body and adjacent to the gripping or holding members, wherein each of the two opposing lugs extend laterally from the body in opposing directions by at least 15 cm, wherein the two opposing lugs are moveable relative to the body, and wherein the body has a thickness of from 15 to 30 cm and each of the two opposing lugs has a thickness of up to 10 cm and a length of from 20 to 40 cm, wherein the tackle shield comprises a C-shaped curved profile and the continuous solid body front contact surface further comprises extending from the central portion an upper forward projection having a head distal end and a lower forward projection having a lip distal end, the upper and lower forward projections disposed at an angle to one another, taking the nearest fit line through the respective upper and lower forward projections, of from 60 to 105° and a recess therebetween, wherein the upper forward projection and lower forward projection define a volume in the recess of from 17.5 litres to 40 litres, wherein the head distal end and lip distal end are separated by from 40 to 60 cm, wherein the upper forward projection extends from a mid-point of the central portion by an amount of from 30 to 45 cm and wherein the lower forward projection extends from a mid-point of the central portion by an amount of from 30 to 50 cm and wherein the lower forward projection extends by no more than 30% more than the upper forward projection.

2. The tackle shield as claimed in claim 1, wherein the lugs project from a side surface of the body by an amount of up to 25 cm.

3. The tackle shield as claimed in claim 1, wherein the rear holding surface further comprises a holding zone within which the gripping or holding members are disposed, the holding zone being in the middle third of the body.

4. The tackle shield as claimed in claim 1, wherein the body has a height of from 50 to 75 cm.

5. The tackle shield as claimed in claim 1, wherein the lugs are 15 generally planar, defining a curved member.

6. The tackle shield as claimed in claim 1, which further comprises one or multiple sensors at one ore more locations about the front contact surface of the body and/or on the opposing lugs for determining one or more of point of 20 contact, duration of contact and strength of contact.

7. The tackle shield as claimed in claim 6, wherein the tackle shield further comprises a sensor or sensors, such as an accelerometer or gyrometer, for determining one or more of the distance, speed and direction of movement of the 25 shield during a training exercise.

8. The tackle shield as claimed in claim 6, wherein the sensors are configured for wireless communication of contact data to microprocessor for analysis.

* * * * *